US012486601B2

(12) United States Patent
Kozera

(10) Patent No.: US 12,486,601 B2
(45) Date of Patent: Dec. 2, 2025

(54) MULTI-PLY KNIT FABRIC

(71) Applicant: MMI-IPCO, LLC, Spartanburg, SC (US)

(72) Inventor: Marina Kozera, Portland, OR (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 17/993,411

(22) Filed: Nov. 23, 2022

(65) Prior Publication Data

US 2023/0193531 A1 Jun. 22, 2023

Related U.S. Application Data

(60) Provisional application No. 63/292,244, filed on Dec. 21, 2021.

(51) Int. Cl.
*D04B 9/38* (2006.01)
*D04B 1/10* (2006.01)
(Continued)

(52) U.S. Cl.
CPC ..... *D04B 9/38* (2013.01); *D04B 1/102* (2013.01); *D04B 9/42* (2013.01); *D04B 39/04* (2013.01);
(Continued)

(58) Field of Classification Search
CPC . D04B 1/24; D04B 1/12; D04B 1/108; D04B 1/123; D04B 21/08; D04B 21/14;
(Continued)

(56) References Cited

U.S. PATENT DOCUMENTS 2,401,830 A 6/1946 Kahil
2,921,456 A 1/1960 Evans
(Continued)

FOREIGN PATENT DOCUMENTS

AT 362042 4/1981
CN 1276291 12/2000
(Continued)

OTHER PUBLICATIONS

International Search Report and Written Opinion; PCT/US18/50890; Nov. 21, 2018; 22 pages.
(Continued)

*Primary Examiner* — Aiying Zhao
(74) *Attorney, Agent, or Firm* — Cheryl J. Brickey

(57) ABSTRACT

A multi-ply knit fabric containing a first knit ply containing a plurality of first and second yarns, where the first knit ply forms the upper surface of the fabric. The first knit ply contains a first knit pattern having a repeating pattern of first areas and second areas, where within the first areas the first and second yarns are knitted together and within the second areas the first yarns are knitted together and the second yarns float across approximately the entire second areas. The first areas and second areas have at least one dimension within the plane of the first ply knit of at least about 0.5 mm. The fabric also contains a second knit ply forming the lower surface of the fabric and a plurality of stuffer yarns located between the first and second knit ply.

6 Claims, 4 Drawing Sheets

(51) Int. Cl.
*D04B 9/42* (2006.01)
*D04B 39/04* (2006.01)

(52) U.S. Cl.
CPC .. *D10B 2401/021* (2013.01); *D10B 2403/021* (2013.01)

(58) Field of Classification Search
CPC ..... D04B 21/207; D10B 2331/04; D10B 2403/023; D10B 2501/00; D10B 2403/02; D10B 2401/10; A41D 31/06; A41D 31/065; A41D 2400/10; A41D 2500/10; Y10T 442/45; Y10T 442/456
See application file for complete search history.

(56) References Cited

U.S. PATENT DOCUMENTS

| | | | | |
|---|---|---|---|---|
| 4,199,633 | A | 4/1980 | Blore | |
| 5,569,233 | A | 10/1996 | Goulait | |
| 5,787,503 | A | 8/1998 | Murphy, III | |
| 6,156,406 | A | 12/2000 | Rock | |
| 6,277,469 | B1 | 8/2001 | Wildeman | |
| 6,779,368 | B2 | 8/2004 | Rock | |
| 6,828,003 | B2 | 12/2004 | Rock | |
| 7,217,456 | B1 | 5/2007 | Rock | |
| 7,380,421 | B1 | 6/2008 | Liu | |
| 7,579,045 | B2 | 8/2009 | Rock | |
| RE41,574 | E | 8/2010 | Rock | |
| 7,776,421 | B2 | 8/2010 | Rock | |
| 7,829,172 | B2 | 11/2010 | Rock | |
| 8,129,296 | B2 | 3/2012 | Rock | |
| 8,298,645 | B2 | 10/2012 | Rock | |
| 10,130,129 | B2 | 11/2018 | Rock | |
| 2003/0096548 | A1 | 5/2003 | Groitzsch | |
| 2005/0287894 | A1 | 12/2005 | Burns | |
| 2009/0019614 | A1 | 1/2009 | Hagihara | |
| 2011/0117353 | A1 | 5/2011 | Henshaw | |
| 2011/0177294 | A1* | 7/2011 | Rock | B32B 3/28 428/166 |
| 2012/0260422 | A1 | 10/2012 | Rock | |
| 2013/0065470 | A1 | 3/2013 | Rock | |
| 2014/0087104 | A1 | 3/2014 | Kierderle | |
| 2015/0104604 | A1* | 4/2015 | Rock | B32B 5/26 5/413 R |
| 2018/0179678 | A1 | 6/2018 | Dorton | |
| 2018/0236748 | A1 | 8/2018 | Rock | |
| 2019/0078241 | A1* | 3/2019 | Rose | D04B 1/16 |
| 2022/0097340 | A1 | 3/2022 | Rock | |
| 2022/0282409 | A1* | 9/2022 | Hendry | D04B 1/123 |
| 2025/0027236 | A1 | 1/2025 | Wiles | |

FOREIGN PATENT DOCUMENTS

| | | | | | |
|---|---|---|---|---|---|
| DE | 102014006212 | A1 | | 12/2014 | |
| DE | 102016102792 | | | 8/2017 | |
| EP | 0195355 | | | 9/1986 | |
| EP | 2354282 | | | 8/2011 | |
| EP | 3480350 | | | 5/2019 | |
| GB | 1577399 | A | | 10/1980 | |
| JP | 2002371449 | A | | 12/2002 | |
| JP | 2003013346 | | | 1/2003 | |
| JP | 2003013346 | A | * | 1/2003 | A47C 31/006 |
| JP | 2015030944 | A | * | 2/2015 | |
| WO | WO-2021035563 | A1 | * | 3/2021 | D04B 1/123 |
| WO | 2023121834 | A1 | | 6/2023 | |

OTHER PUBLICATIONS

International Search Report and Written Opinion issued in App. No. PCT/US2022/051196, mailing date May 15, 2023, 27 pages.
International Search Report and Written Opinion issued in App. No. PCT/US2023/010925, mailing date May 15, 2023, 13 pages.
International Search Report and Written Opinion issued in App. No. PCT/US2024/37612, dated Oct. 14, 2024, 14 pages.

* cited by examiner

MULTI-PLY KNIT FABRIC

RELATED APPLICATIONS

This application claims priority to Provisional Patent Application 63/292,244 filed on Dec. 21, 2021, which is herein incorporated by reference.

TECHNICAL FIELD OF THE INVENTION

The present invention is directed multi-ply knit fabrics, more particularly to multi-ply knit fabrics for garments.

BACKGROUND

Performance fabrics manufactured for use in insulating garments often include fleece fabric, i.e. fabric having a raised or brushed fiber surface for improved insulation performance. The surface of such fabrics is often formed of fleece, which is raised, i.e., given relatively higher loft, by mechanical brushing. It has, however, been recognized that the brushing process can often result in broken fibers, which, over time, can work loose, potentially resulting in microfiber pollution. Loss of fibers, e.g., during washing, can also result in deterioration of insulation performance. Further, it is recognized that broken fibers released during washing can get into wastewater, causing pollution. It is desirable to have a low fiber loss, low weight, and high insulative fabric for use in outerwear and other garment uses.

BRIEF SUMMARY OF THE INVENTION

The invention relates to a multi-ply knit fabric having an upper and lower surface and a length and a width. The fabric contains a first knit ply containing a plurality of first and second yarns, where the first knit ply forms the upper surface of the fabric. The first knit ply contains a first knit pattern having a repeating pattern of first areas and second areas, where within the first areas the first and second yarns are knitted together and within the second areas the first yarns are knitted together and the second yarns float across approximately the entire second areas. The first areas and second areas have at least one dimension within the plane of the first ply knit of at least about 0.5 mm. The fabric also contains a second knit ply comprising a plurality of third yarns, where the second knit ply forms the lower surface of the fabric and a plurality of stuffer yarns located between the first knit ply and the second knit ply. The first ply and the second ply are integrated through combined portions formed by at least one method selected from the group consisting of interlacing first or second yarns of the first knit layer among the third yarns of the second knit ply, interlacing the third yarns of the second ply among the first or second yarns of the first knit ply, and interlacing a plurality of fourth yarns among the first or second yarns of the first knit ply and the third yarns of the second knit ply.

In another embodiment, the invention relates to a multi-ply knit fabric having an upper and lower surface and a length and a width. The fabric contains a first knit ply containing a plurality of first areas and second areas, wherein the air permeability of the second areas is greater than the air permeability of the first areas, where the first areas and second areas have at least one dimension within the plane of the first ply knit of at least about 2 mm. The fabric also contains a second knit ply comprising a plurality of third yarns, where the second knit ply forms the lower surface of the fabric and a plurality of stuffer yarns located between the first knit ply and the second knit ply. The first ply and the second ply are integrated through combined portions formed by at least one method selected from the group consisting of interlacing first or second yarns of the first knit layer among the third yarns of the second knit ply, interlacing the third yarns of the second ply among the first or second yarns of the first knit ply, and interlacing a plurality of fourth yarns among the first or second yarns of the first knit ply and the third yarns of the second knit ply.

In another embodiment, the invention relates to a multi-ply knit fabric having an upper and lower surface and a length and a width. The fabric contains a first knit ply containing a plurality of first and second yarns, where the first knit ply forms the upper surface of the fabric and where the first knit ply comprises a first knit pattern having a repeating pattern of first areas and second areas. Within the first areas, the first and second yarns have a knit pattern of knit stitches and within the second areas the first yarns have a knit pattern of knit stitches and the second yarns have a knit pattern of miss stitches. The first areas and second areas have a at least one dimension within the plane of the first ply knit of at least about 2 mm. The fabric also contains a second knit ply comprising a plurality of third yarns, where the second knit ply forms the lower surface of the fabric and a plurality of stuffer yarns located between the first knit ply and the second knit ply. The first ply and the second ply are integrated through combined portions formed by at least one method selected from the group consisting of interlacing first or second yarns of the first knit layer among the third yarns of the second knit ply, interlacing the third yarns of the second ply among the first or second yarns of the first knit ply, and interlacing a plurality of fourth yarns among the first or second yarns of the first knit ply and the third yarns of the second knit ply.

In another embodiment, the invention relates to a multi-ply knit fabric having an upper and lower surface and a length and a width. The fabric contains a first knit ply containing a plurality of first and second yarns, where the first knit ply forms the upper surface of the fabric and where the first knit ply comprises a first knit pattern having a repeating pattern of first areas and second areas. The first areas have approximately twice the number of knit stitches per unit area than the second areas. The first areas and second areas have a at least one dimension within the plane of the first ply knit of at least about 2 mm. The fabric also contains a second knit ply comprising a plurality of third yarns, where the second knit ply forms the lower surface of the fabric and a plurality of stuffer yarns located between the first knit ply and the second knit ply. The first ply and the second ply are integrated through combined portions formed by at least one method selected from the group consisting of interlacing first or second yarns of the first knit layer among the third yarns of the second knit ply, interlacing the third yarns of the second ply among the first or second yarns of the first knit ply, and interlacing a plurality of fourth yarns among the first or second yarns of the first knit ply and the third yarns of the second knit ply.

DETAILED DESCRIPTION

Figure 1:
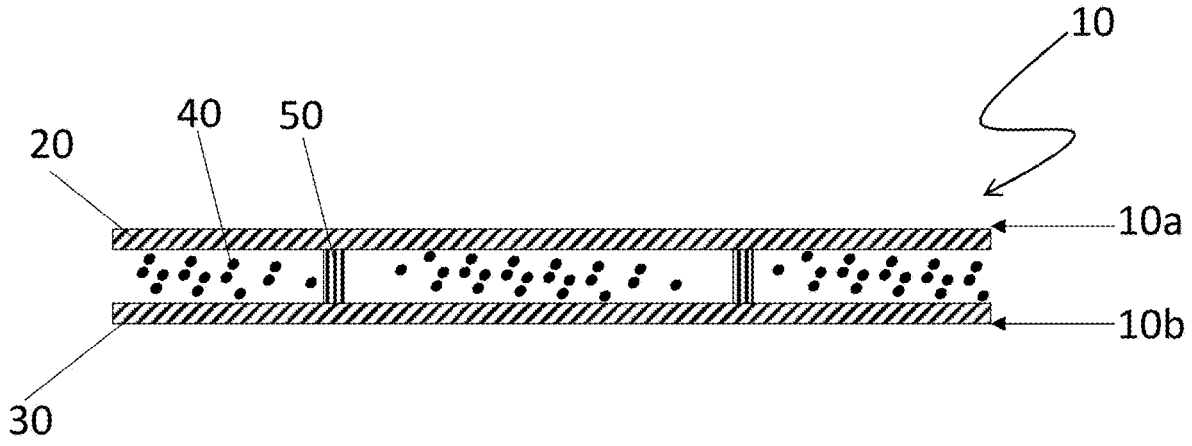
FIG. 1 is an illustration of a cross-section of the multi-ply knit fabric according to one embodiment of the invention.

Referring now to FIG. 1, the multi-ply knit 10 of the invention has an upper surface 10*a* and a lower surface 10*b*, a length and a width, and contains a first knit ply 20, a second knit ply 30, and a plurality of stuffer yarns 40. The first knit ply 20 forms the upper surface 10*a* of the multi-ply knit 10, the second knit ply 30 forms the lower surface 10*b* of the multi-ply knit 10, and the stuffer yarns 40 are located between the first 20 and the second 30 knit plies. The yarns connecting the first and second knit plies 20, 30 are connecting yarns 50.

Figure 2:
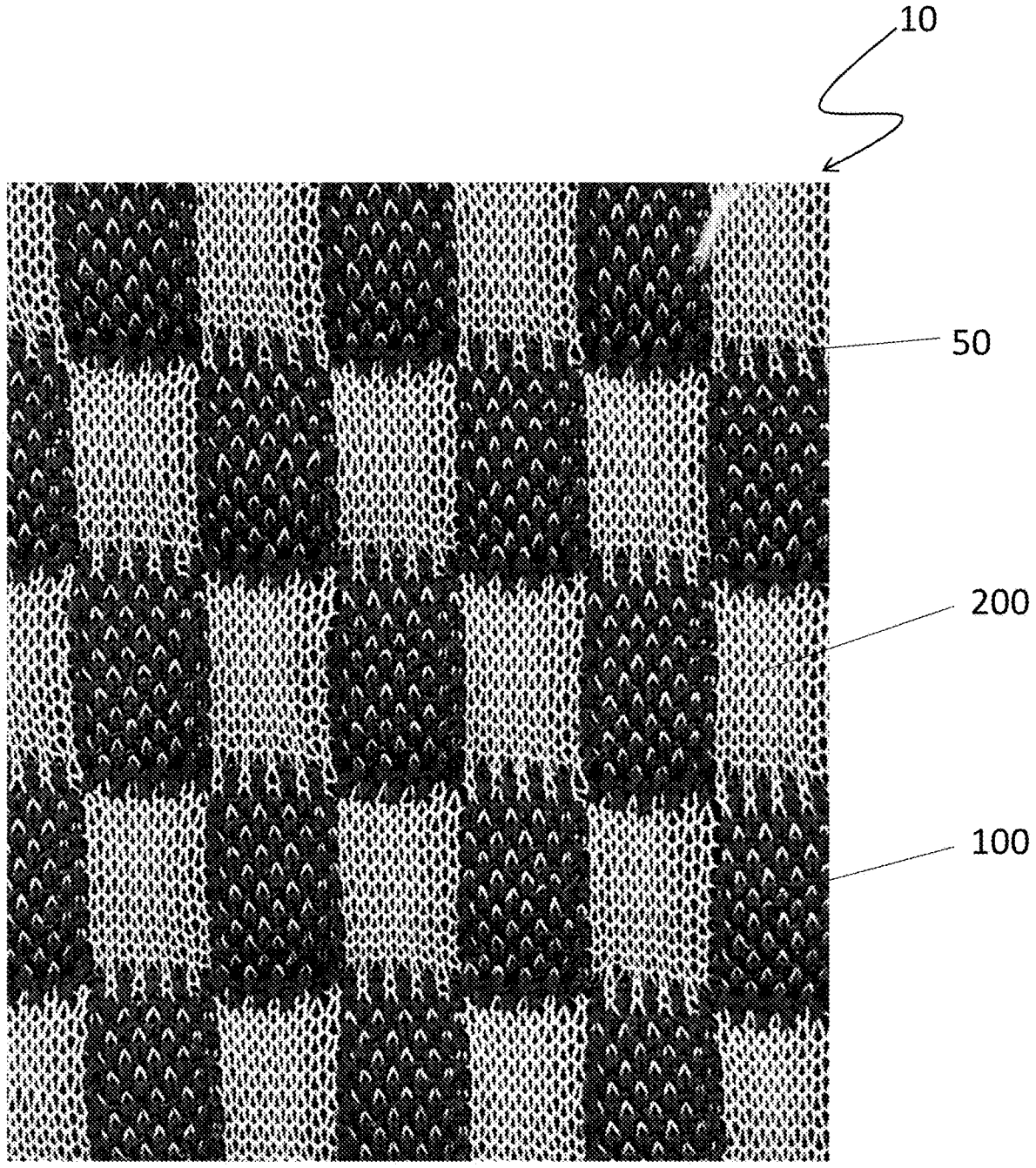
FIG. 2 is photograph of the upper surface of the multi-ply knit fabric according to one embodiment of the invention.

In FIG. 2, there is shown a photograph of the upper surface 10*a* of the multi-ply knit 10 which is the first knit ply 20. The first knit ply 20 contains a plurality of first yarns and second yarns. In the embodiment photographed, the first yarns are white colored, and the second yarns are black colored so that the knit pattern can be more easily seen. The first knit ply 20 contains a repeating pattern of first areas 100 and second areas 200. The repeating pattern shown in FIG. 2 is a repeating pattern of rectangles, but the repeating pattern can be of any suitable shapes such as triangles, squares, octagons, hexagons, and more. Preferably, the pattern is a repeating pattern of repeating rectangular grid of first and second areas. In one embodiment, the first ply contains third areas that may have different yarns and/or knit stitches than the first and second areas.

In one embodiment, the first 100 and second 200 areas of the first ply have different amounts of hydrophobicity. In one embodiment, the first areas have a higher degree of hydrophobicity than the second areas and in another embodiment, the second areas have a higher degree of hydrophobicity than the first areas. In the embodiment shown in FIG. 2, the white yarns are polypropylene, and the black yarns are polyester. Polypropylene is more hydrophobic than the polyester and thus the second areas which only contain polypropylene knit stitches, the second areas are more hydrophobic than the first areas.

In one embodiment, the second areas 200 of the first ply 20 have a higher air permeability than the first areas 100 of the first ply 20. In one embodiment, the air permeability of the second areas is at least 10% greater, more preferably at least about 30% greater. Preferably, the second area is more open than the first area, meaning that there are fewer knit stitches per area unit in the second area compared to the first area. In one embodiment, the second areas 200 of the first ply 20 have a higher degree of openness than the first areas 100 of the first ply 20. In one embodiment, the openness of the second areas is at least 10% greater, more preferably at least about 30% greater.

In FIG. 2, the surface area of the first areas 100 is approximately equal to the surface area of the second areas 200 (meaning that if you added up all of the surface areas of each repeating shape for the first areas it would be approximately the same as the surface area of all of the second areas 200). In one preferred embodiment, the surface area of the first areas is between about 40 and 60% of the surface of the first ply, more preferably between about 45 and 55% of the surface of the first ply. In another embodiment, the first areas 100 form a much larger portion of the surface of the first knit ply 20. In this embodiment the surface area of the first areas is between about 60 and 90% of the surface of the first ply, more preferably between about 65 and 80% of the surface of the first ply. In another embodiment, the first areas 100 form a much smaller portion of the surface of the first knit ply 20. In this embodiment the surface area of the first areas is between about 10 and 40% of the surface of the first ply, more preferably between about 15 and 35% of the surface of the first ply. The first areas 100 and the second areas 200 preferably have at least one dimension in the plane of the first knit ply of at least about 0.5 mm, more preferably at least about 2 mm, more preferably at least about 4 mm. Each of the first areas 100 and the second areas 200 contain a plurality of knit stitches.

Figure 3:
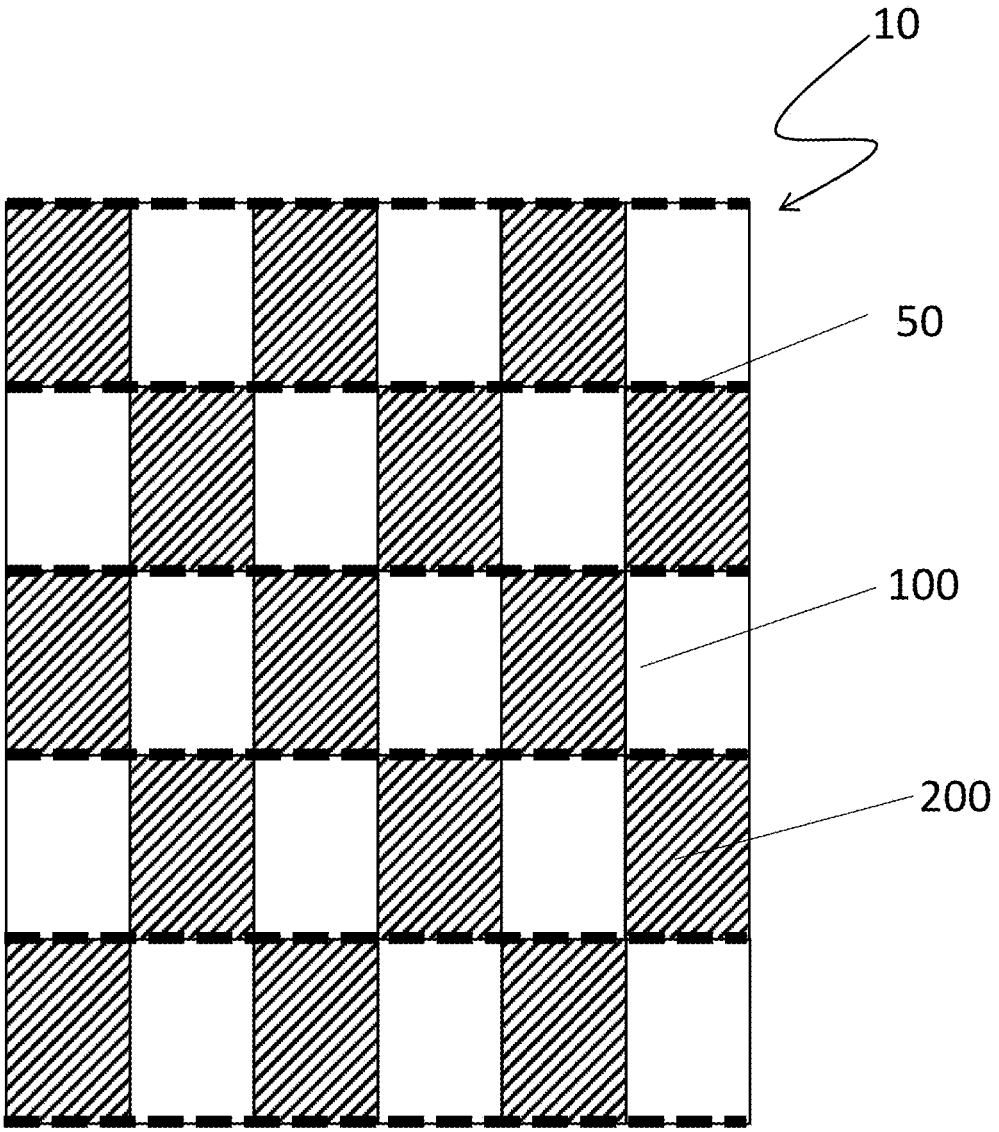
FIG. 3 is an illustration of the upper surface of the multi-ply knit fabric according to one embodiment of the invention.

Referring back to the photograph of FIG. 2, one can see that in the first areas 100, the first (white) and second (black) yarns are knitted together. Both the first and the second yarns have a pattern of knit stitches. On the other hand, in the second areas 200, one can only see that the first (white) yarns are knitted together. From this top-down view, the second yarns (black) cannot be seen. In these second areas 200, the first yarns are knitted together in knit stitches and the second yarns float across approximately the entire second areas behind the knitted first yarns (so on the side of the first ply facing the second ply) by having a knit pattern of miss stitches. The second yarns float on the back on of the first ply (the side of the first ply that faces the second knit ply). Having these areas with different knits (and different amounts of yarns within the knit stitches) creates areas having different stitch density and air permeability. In one embodiment, the first areas 100 have approximately twice the number of knit stitches per unit area than the second areas 200 (as half of the yarns in the second areas 200 are floating along the back of the fabric and are not involved in the knit stitches). FIG. 3 is an illustrative version of the photograph of FIG. 2.

The yarns that make up the first ply 20 can be any suitable yarn. "Yarn", in this application, as used herein includes a monofilament elongated body, a multifilament elongated body, ribbon, strip, yarn, tape, fiber and the like. The first knit ply 20 may contain one type of yarn or a plurality of any one or combination of the above. The yarns may be of any suitable form such as spun staple yarn, monofilament, or multifilament, single component, bi-component, or multi-component, and have any suitable cross-section shape such as circular, multi-lobal, square or rectangular (tape), and oval.

The yarns of the first ply 20 may be formed of (but are not limited to) cellulosic yarns (such as cotton, rayon, linen, jute, hemp, cellulose acetate, and combinations, mixtures, or blends thereof), polyester yarns (e.g., poly(ethylene terephthalate) yarns, poly(propylene terephthalate) (PET) yarns, poly(trimethylene terephthalate) yarns), poly(butylene terephthalate) yarns, and blends thereof), polyamide yarns (e.g., nylon 6 yarns, nylon 6,6 yarns, nylon 4,6 yarns, and nylon 12 yarns), polyvinyl alcohol yarns, an elastic polyester-polyurethane copolymer (SPANDEX®), polypropylene yarns, polyethylene yards, polyvinyl acetate yarns, polylactic acid yarns, flame-resistant meta-aramid (NOMEX®) or para-aramid, and combinations, mixtures, or blends thereof. In the sample fabric shown in FIG. 2, the white colored yarns are continuous multifilament polypropylene, and the black colored yarns are continuous multifilament polyester. In one preferred embodiment, the first ply 20 contains multifilament polyester yarns as these have been shown to have good performance at low cost. In one embodiment, the first ply 20 contains essentially all (defined as being at least about 98% by weight) multifilament polyester yarns. In one embodiment, the yarns that make up the first ply all have approximately the same thickness or denier. In other embodiments, there is a difference in denier. In the example fabric shown in FIG. 2, the white polypropylene yarns are thinner (lower denier) than the black polyester yarns.

The second knit ply 30 which forms the lower surface 10*b* of the multi-ply knit 10 contains a plurality of third yarns and may be of any suitable knit stitch. In one preferred embodiment, the knit stitches are consistent across the entire second knit 30. The second knit ply preferably contains one type of yarn but may also contain multiple types of yarns knitted together or in different patterns. These patterns may be in registration with the first ply or may be independent of the first ply pattern of areas. In one embodiment, both the first and second plies contain the two area 100, 200 type window pattern shown for the first ply in FIG. 2 and these patterns may or may not be in registration with each other. The materials of the yarns making up the second ply are the same as listed for the first ply. Preferably, the second ply 20 contains essentially all (defined as being at least about 98% by weight) multifilament polyester yarns.

In one preferred embodiment, the second ply contains the same knit pattern across the entire length and width (excluding selvedges and/or edge effects). In one embodiment, the air permeability of the second ply varies less than about 30% (more preferably less than about 15%) across the length and width of the multi-ply knit fabric. In another embodiment, the openness of the second ply varies less than about 30% (more preferably less than about 15%) across the length and width of the multi-ply knit fabric. Preferably, the second ply 30 has essentially the same (defined as less than a 10% variation) of hydrophobicity across the length and width of the ply.

The two plies 20 and 30 may be combined and joined together (during knitting) in any suitable manner combined portions 50. A first method is interlacing yarns from the first ply 20 (first and/or second yarns from the first ply) among the yarns of the second knit ply 30, meaning that a portion of the yarns from the first ply leave the first ply, travel down into the second ply where they are interlaced with yarns within the second ply, and then travel back up to the first ply.

A second method is interlacing yarns from the second ply 30 among the yarns of the first knit ply 20, meaning that a portion of the yarns from the second ply 30 leave the second ply, travel up into the first ply where they are interlaced with yarns within the first ply, and then travel back down to the second ply to the first ply.

A third method is interlacing a plurality of additional yarns in among the yarns of the first knit ply 20 and the yarns of the second knit ply 30. This means that an additional yarn (which may be the same or different yarn than the yarns in the first or second plies) travels between the plies, interlacing with yarns from both plies and in essence, tying them together. This additional yarn may be selected from any of the yarns described in reference to the yarns in the first ply.

In a preferred embodiment, the second method is used to interlace the first 20 and second 30 ply together. This method may be preferred because of the lower complexity during the knitting process using the circular knitting.

The combined portions preferably are in a pattern across the length and/or width of the fabric. This can be seen, for example, in FIG. 3 which is an illustration of the fabric of FIG. 2. In this sample, the combined portions are spaced apart parallel lines located between the patterns of first and second areas. Having the combined portions be linear forms long pocket channels that make the insertion of the stuffer yarns 40 into the fabric 10. The combined portions may also be dots where only one or a few knit stitches are used to tie the two plies together, plus signs, outlines of each area 100, 200 or any other suitable pattern.

Figure 4:
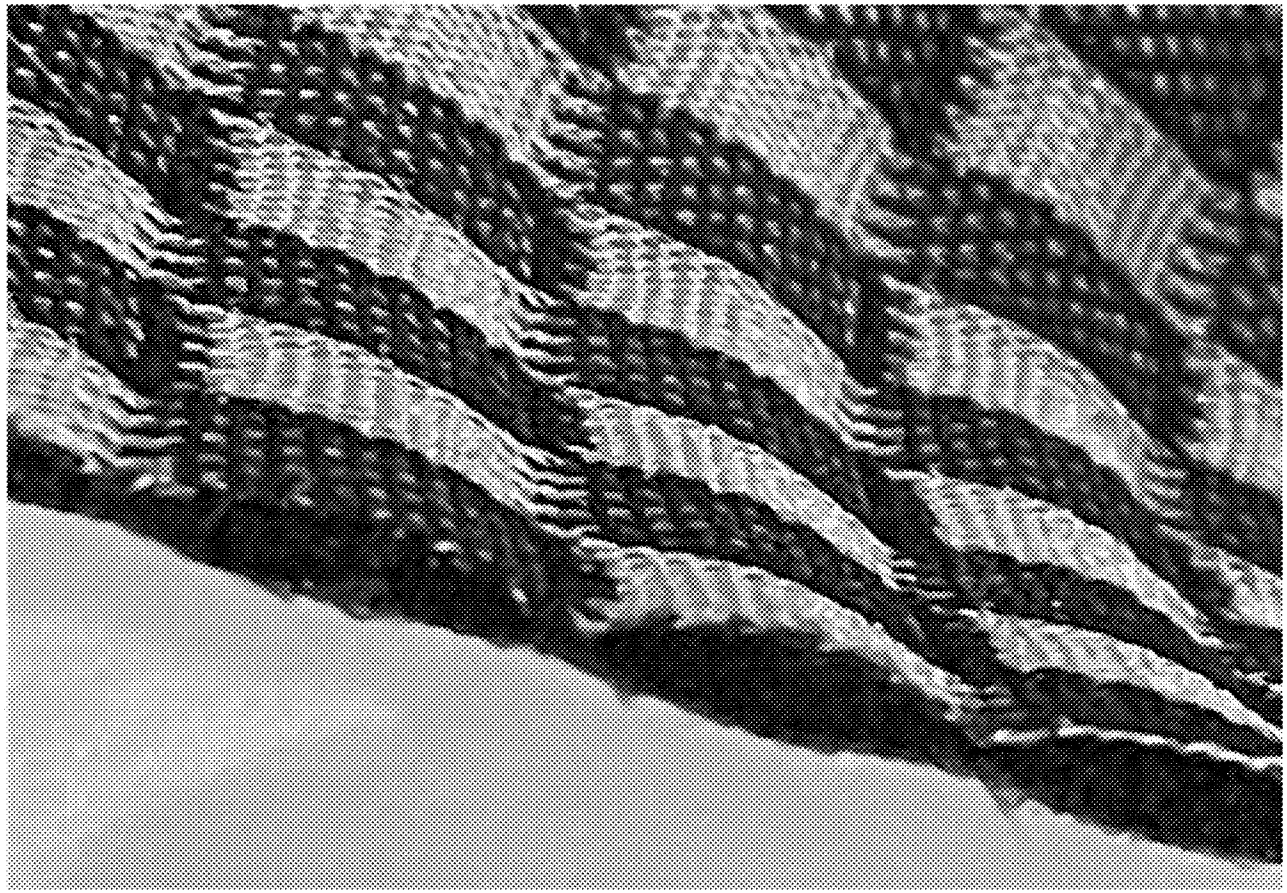
FIG. 4 is angled photograph of the multi-ply knit fabric according to one embodiment of the invention.

Referring back to FIG. 1, there are also fabric also contains a plurality of stuffer yarns 40 located between the first ply 20 and the second ply 30 (preferably between the combined portions 50). These stuffer yarns may be any suitable yarn and are preferably bulky so that they fill up the areas between the first and second plies and provides insulation. Preferably, the stuffer yarns are a multifilament polyester yarn. It has been shown that polyester yarns may be easily bulked and retain their volume over time. In one preferred embodiment, the stuffer yarns are faux twist textured yarns. For the case where the combined portions are spaced apart parallel lines, the stuffer yarns are located in the channels formed by the combined portions, first ply, and second ply and are generally parallel to the combined portions. FIG. 4 shows a top/side view of the fabric of FIG. 2. One can see the black stuffer yarns and how the stuffer yarns fill up and make into a pillow like structure the areas between the linear combined portions.

In one preferred embodiment, the entire fabric is mostly polyester yarns, more preferably continuous multifilament polyester yarns. In another embodiment, the entire fabric (including the first ply, the second ply, the stuffer yarns, and any additional yarns) is essentially all (defined as at least 98% by weight) polyester yarns, more preferably continuous multifilament polyester yarns.

Thickness of both plies 20, 30 may be any suitable thickness and may be approximately equally distributed, or one of the plies may thicker than the other. Typical thickness of the fabric is between about 0.1 and 6 mm, more preferably between about 1 and 4 mm.

When the fabric 10 is made into an article of clothing (also referred to as a garment), in one embodiment the lower surface 10*b* would be facing the wearer and upper surface 10*a* would be facing away from the wearer. In another embodiment, the lower surface 10*b* would be facing away from the wearer and upper surface 10*a* would be facing towards the wearer. The knit fabric 10 is a unitary material that is formed together in a knitting machine with the two plies sometimes being separate and sometimes knitted together. The plies 20 and 30 are not formed as discrete knit layers and then joined together in a later operation. The fabric 10 may be made by any suitable knitting method, including both warp knitting and weft (or circular) knitting. Circular knitting is preferred in some embodiments, as it tends to be more cost efficient. The article of clothing may be any suitable article including but not limited to a shirt, jacket, pants, tights, leggings, hat, undergarments, and socks.

In another embodiment, a garment may use the fabric in addition to other fabric. For example, a shirt might use the fabric of the invention on the torso and another fabric in the sleeves. Additionally, the fabric of the invention could also be used as an insert.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A multi-ply knit fabric having a first surface and a second surface and a first direction and a second direction, wherein the fabric comprises:

a first knit ply comprising a plurality of first yarns and a plurality of second yarns, wherein the first knit ply forms the first surface of the fabric, wherein the first knit ply comprises a first knit pattern having a repeating pattern of first areas and second areas, wherein within the first areas the first and second yarns are knitted together and within the second areas the first yarns are knitted together and the second yarns float across approximately the entire second areas, wherein the first areas and second areas have at least one dimension within a plane of the first ply knit of at least 2 mm, wherein the first knit ply has a first knit ply surface area and the first areas have a first area surface area, wherein the first area surface area is between 40% and 60% of the first knit ply surface area, and wherein floats of the second yarns are located on a surface of the first ply facing the second ply;

a second knit ply comprising a plurality of third yarns, wherein the second knit ply forms the second surface of the fabric; and, a plurality of stuffer yarns located between the first knit ply and the second knit ply;

wherein the first ply and the second ply are integrated through combined portions formed by interlacing the third yarns of the second ply among the first or second yarns of the first knit ply, wherein the combined portions are located in parallel lines in the second direction of the multi-ply knit fabric between the patterns of first and second areas forming pocket channels, and wherein the stuffer yarns are located in the pocket channels between the first knit ply and the second knit ply and are generally parallel to the combined portions.

2. The multi-ply knit fabric of claim 1, wherein the first areas have approximately twice the number of knit stitches per unit area than that of the second areas.

3. The multi-ply knit fabric of claim 1, wherein the first and second areas of the first ply having different amounts of hydrophobicity.

4. The multi-ply knit fabric of claim 1, wherein the first knit pattern comprises a repeating rectangular grid of first and second areas.

5. The multi-ply knit fabric of claim 1, wherein an air permeability of the second areas is greater than an air permeability of the first areas, wherein the first areas have an openness and the second areas have an openness, and wherein the openness of the second area is greater than the openness of the first areas.

6. The multi-ply knit fabric of claim 1, wherein the multi-ply knit fabric comprises at least 98% by weight continuous multifilament polyester yarns.

* * * * *